United States Patent [19]

Langelier

[11] Patent Number: 4,762,299

[45] Date of Patent: Aug. 9, 1988

[54] PEG BOARD HOOKING SUPPORT ROD

[76] Inventor: André Langelier, 5690 Robert Boulevard, Saint-Léonard, Canada, H1P 1M4

[21] Appl. No.: 56,699

[22] Filed: Jun. 2, 1987

[51] Int. Cl.[4] ..... A47F 5/00

[52] U.S. Cl. ..... 248/220.4; 211/59.1

[58] Field of Search ..... 248/220.3, 220.4, 222.2, 248/223.4, 224.3, 216.1, 546, 71, 220.2, 205.3, 339, 301, 304; 211/59.1, 57.1, 54.1

[56] References Cited

U.S. PATENT DOCUMENTS

| | | | |
|---|---|---|---|
| 3,198,469 | 8/1965 | Callanan | 248/220.4 |
| 3,339,871 | 9/1967 | Larson . | |
| 3,677,415 | 7/1972 | Radek . | |
| 3,921,812 | 11/1975 | Hamrock et al. | 248/220.4 |
| 3,964,712 | 6/1976 | Staudte, Jr. . | |
| 3,976,201 | 8/1976 | Hodgson et al. | 248/220.4 X |
| 3,985,324 | 10/1976 | Larson . | |
| 4,516,681 | 5/1985 | Jahel | 248/220.4 X |

FOREIGN PATENT DOCUMENTS

| | | | |
|---|---|---|---|
| 2042122 | 2/1972 | Fed. Rep. of Germany | 248/223.4 |
| 2386718 | 12/1978 | France | 248/220.4 |
| 2546048 | 11/1984 | France | 248/220.3 |

*Primary Examiner*—David L. Talbott

[57] ABSTRACT

A hook rod to be secured to a peg board for displaying articles. A pair of transverse inversely C-shaped fingers, at the top of a mounting bracket plate, releasably engage a pair of horizontally registering peg board bores for anchoring the bracket plate to the peg board. A rectangular sleeve is mounted on the upper portion of the bracket plate to define a vertical channel. An intermediately bent connector plate is fixedly secured at one end to the top face of the inner end of the hook rod, while the other end of the connector plate is releasably frictionally engageable in the vertical channel.

12 Claims, 2 Drawing Sheets

PEG BOARD HOOKING SUPPORT ROD

FIELD OF THE INVENTION

The invention relates to a hook for displaying articles in front of a peg board.

BACKGROUND OF THE INVENTION

Simple pegboards include a panel, mounted vertically and having a plurality of equally spaced bores. Each bore is engageable by a bent end of an elongated hook rod. Each rod is maintained transverse to the panel by providing a downturned leg to the rod, in front of the panel to abut against the latter. To engage the rod in its panel bore, one needs therefore to <pivot> the rod through at least a roughly 45-degree-circle of arc vertical sweep. Hence, overlying clearance above the rod must be important, and increasingly so with the length of the rod.

One or several articles may be suspended to the peg board rod. The weight of these articles usually tends to enhance the anchoring of the rod to the peg boapd, up to the structural limits of the peg board of course. However, when a last remaining article is removed from a given hook rod, it often happens that the latter becomes released in the process from the peg board panel and falls to the ground: this is obviously not desirable.

The Trion Industries Inc. of Wilkes-Barre, Pa., U.S.A. discloses a wide variety of improved display hooks, including hook rods mounted to a back plate provided with swivelling action means to facilitate instant installation or relocation of the hook on a peg board. But still, on all these display hooks, the hook rod must be <pivoted> when engaging the peg board bore for transverse mounting relative thereto. Thus, the problem of the large overlying clearance required above the display hook rod remains.

OBJECTS OF THE INVENTION

The general object of the invention is thus to provide a display hanger for a pegboard or other vertical support, including a hanger hook and a bracket therefor, said hanger hook capable of being installed to or removed from the bracket with a minimum of vertical clearance space.

A further object of the invention is that the above hanger hook is well anchored to the bracket irrespective of it supporting a load or not, and yet is readily removable therefrom when desired.

A lesser object of the invention is that the above display hanger is adaptable to a variety of types of pegboards.

Another object of the invention is to provide a display hanger providing a labelling surface.

SUMMARY OF THE INVENTION

The display hanger of the invention comprises a hook member and a mounting bracket for releasably supporting the hook member; said mounting bracket defining a panel with a sleeve member, said panel adapted to be fixed to a substantially vertical surface with the axis of said sleeve member substantially vertical; said hook member including an elongated support member adapted to be generally horizontally disposed and a downwardly-extending connector member; said connector member adapted to releasably engage and be retained by said sleeve member along the axis of said sleeve, so that said support member can remain substantially horizontal when said connector member is being engaged or disengaged from said sleeve member.

There is more specifically disclosed a display hanger for a pegboard having rows of bores. The hanger comprises a hook member and a mounting bracket for releasably connecting the hook member to the pegboard. The mounting bracket defines a main body provided at its top end with a pair of transverse fingers. These fingers are of arcuate shape and are adapted to engage a pair of corresponding horizontally-registering pegboard bores in such a way that said bracket is anchored to the pegboard with the main body thereof flatly abutting against the pegboard. The hook member defines an elongated support member and a connector member at the inner end of said support member. A rigid channel member is mounted to the upper portion of said bracket main body, said channel member defining a top mouth. The channel member is releasably frictionally engageable by said connector member through said top mouth to maintain said support member transversely of said pegboard. The area of the main body below said channel member serves as a labelling surface: a label adhered thereto indicates the type of wares hung from the support member.

DETAILED DESCRIPTION OF THE PREFERRED EMBODIMENTS OF THE INVENTION

A peg board conventionally consists of a rigid panel such as 10 (FIG. 1) or 12 (FIG. 4), pierced by a plurality of bores, such as straight bores 14 (FIG. 1) or conical cavity bores 16 (FIG. 4), the bores usually equally spaced from each other in horizontal rows.

Figure 1:
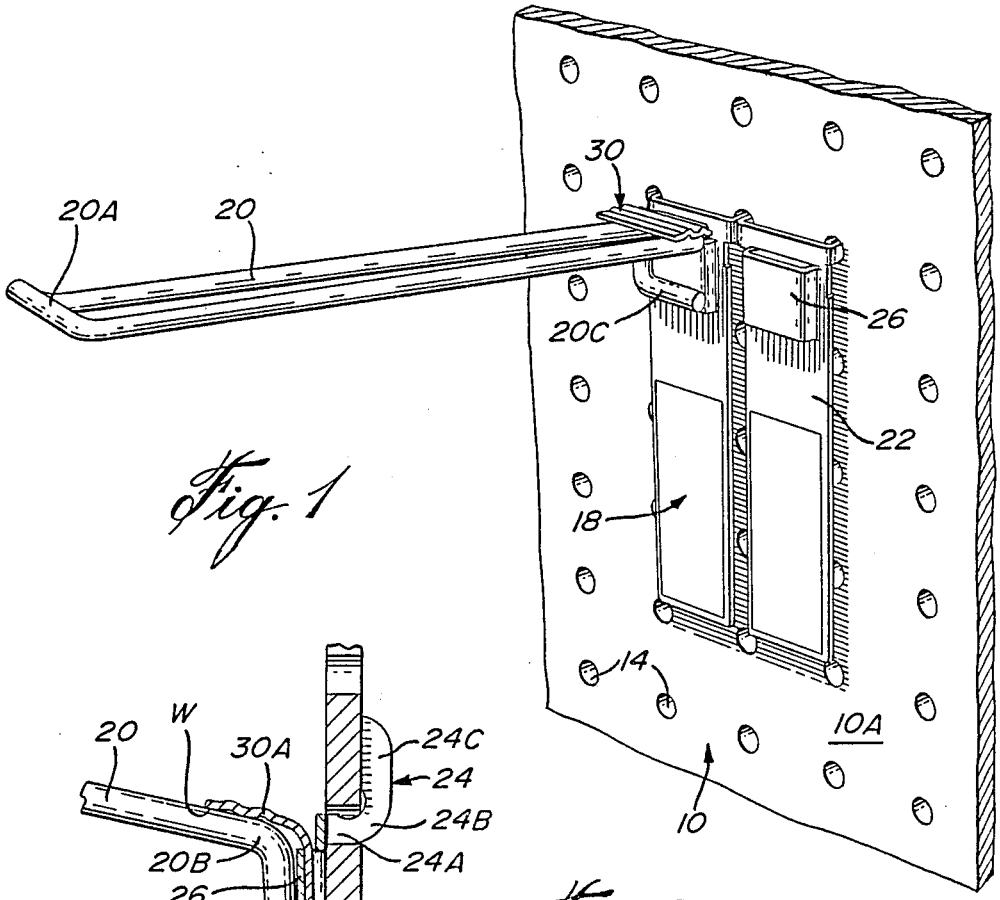
FIG. 1 is a fragmentary perspective view of a first type of peg board, to which is secured a safety loop hook via a mounting assembly constructed in accordance with the teachings of the invention.
Figure 3:
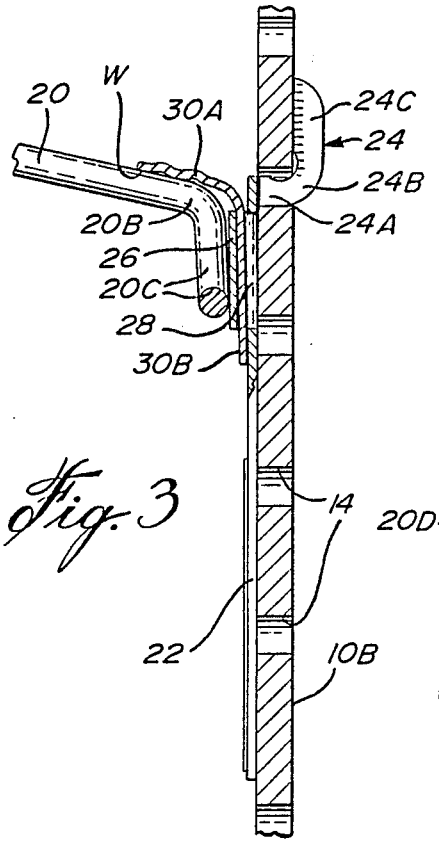
FIG. 3 is a vertical sectional view of the peg board and hook mounting assembly of FIG. 1.
Figure 2:
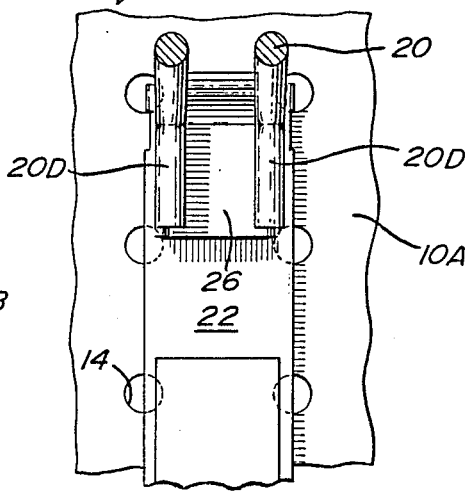
FIG. 2 is an enlarged fragmentary front elevation of the peg board and mounting assembly, showing in cross-section an alternate form of the safety loop hook.

In FIGS. 1 to 3, a mounting bracket member 18 connects an elongated safety loop hook 20 transversely to the plane of peg board 10. Loop hook 20 defines a metallic rod bent in two, the bent portion 20A at the outer end of the hook being slightly upturned to prevent a supported article from accidentally sliding off. Bracket member 18 consists of an elongated quadrangular plate 22 with two integral transverse opposite fingers 24 at its top end. Fingers 2 are arcuate, inversely C-shaped, and each includes a straight portion 24A, an intermediate upwardly rearwardly curved portion 24B, and an enlarged top inturned leg 24C adapted to abut against the rear face 10B of peg board 10 opposite the front face 10A against which rectangular plate 22 abuts.

An outturned partial sleeve 26 is partially struck out from the upper portion of plate 22, just below fingers 24. Partial sleeve 26 defines a vertical channel 28.

The inner ends 20B of hook rod 20 further include a quadrangular connector plate 30, having a first portion 30A fixedly secured by welding W to the top surface of both legs of the rod inner ends 20B, and a second portion 30B length of lower connector portion 30B may be about equal to phe vertical distance between the peg board bores 14. The intermediate obtuse angle of the connector 30 may be about 115 degrees. Plate 30 may be a metal leaf The connector upper portion 30A may have a wavy shape, as shown to facilitate spot welding. The connector bottom portion 30B is adapted to frictionally extend through the top mouth of channel 28 po as to be taken in sandwich between partial sleeve 26 and the adjacent upper and lower sections of wall 22. Thus, hook 20 would make an angle of about 115 degrees with the underlying plane of bracket plate 22 and therefore of peg board 10.

As shown in FIGS. 1 and 3, one leg of rod 20 has a straight inner end while inner end 20B of the other leg includes a downturned L-shaped foot extension 20C adapted to abut against the bottom section of partial sleeve 26 (FIGS. 1 and 3). Alternately, both legs have a downturned extension 20D adapted to abut against the side sections of partial sleeve 26 (FIG. 2).

Bracket plates 22 are installed to the peg board 10 by first engaging the fingers 24 into a pair of adjacent bores 14 of a horizontal row, the bracket plate extending horizontally, and then downwardly pivoting by 90 degrees the bracket plate so that the latter flatly abut against the peg board front face 10A while the the flange legs 24C come to abut against the peg board rear face 10B. As such, each bracket plate 22 may be anchored to the peg board 10 at a position that is totally independent of the positions of the other bracket plates. Also, this operation can be effected at a position just below articles already suspended from a higher row of hook rods.

Finger leg 24C and the bracket plate lower portion 22 cooperate with respective opposite faces of peg board 10 whereby the mounting assembly 18 is thereby well anchored to the peg board and will not be driven off the latter if the latter is e.g. shaken.

Then, hook 20 is secured to anchored mounting assembly 18 by engagement of connector leg 30B through channel 28. An article may then be hung from hook 20. Hook 20 is prevented from downwardly collapsing under load by the combined action of connector 30, the top leg 30A of which is under tension, and of the resistance to flexion of the rod extension 20C or 20D which rest against partial sleeve 26. Connector leg 30B, frictionally engaged in channel 28, prevents undesirable disengagement of hook 20 from mounting assembly 18 when the hung article is removed from the hook 20.

Hook 20 can be secured to be removed from bracket plate 22 while hook 20 remains substantially horizontal. Therefore, the clearance that is required below to the lower end of an overlying hung article, is about only as high as the length of connector portion 30B.

Consequently, hooks 20 and bracket plates 22 can be removed from or attached to the peg board 10 without having to remove articles suspended from hooks of an upper row. Moreover, the available display space can be used to a maximum.

Figure 4:
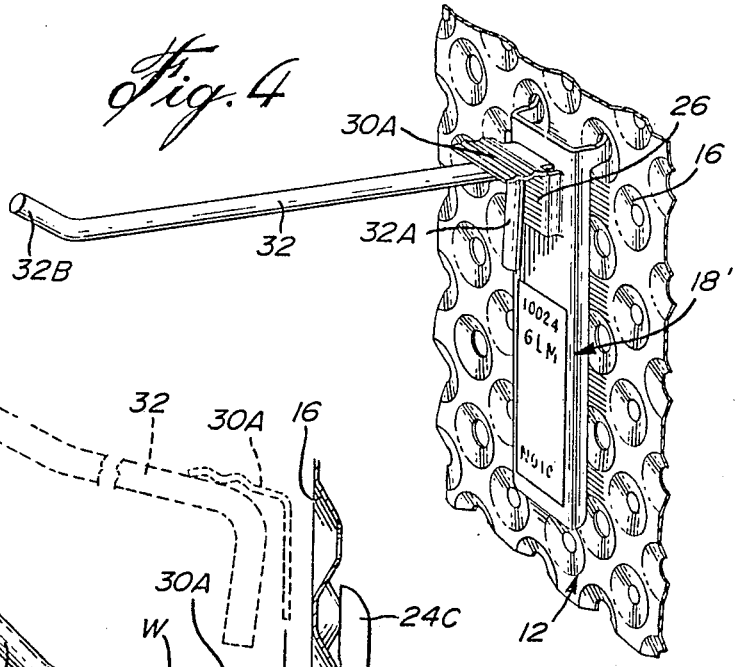
FIG. 4 is the view of FIG. 1 but for a second type of peg board and including a simpler straight-entry hook.
Figure 5:
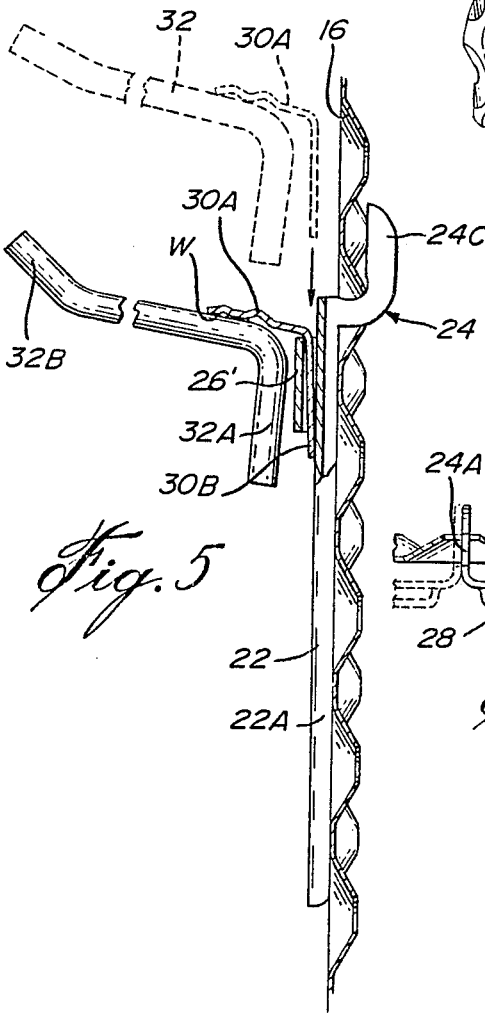
FIG. 5 is the view of FIG. 3, but for the element of FIG. 4, and further showing in dotted lines how the hook is engaged into the peg board mounting assembly.
Figure 6:
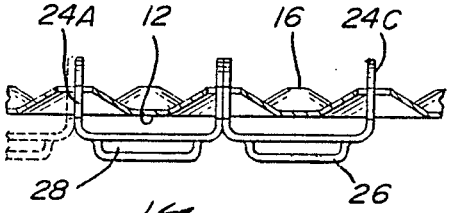
FIG. 6 is a horizontal sectional view of the peg board of FIG. 4, but with the hook removed and showing two adjacent hook mounting assemblies in top plan view and a third one being fragmented and shown in dotted lines.

FIGS. 4 to 6 show a second embodiment of hook 32 and the second known type of peg board 12. The mounting assembly 18 ′ remains substantially the same, except that it has inturned side flanges 22A. As seen in FIG. 5, the rear leg 24C of the bracket plate finger 24 is designed to abut against the base of a rearwardly tapering conical cavity 16 of peg board 12. Elongated hook 32 is a rod of the straight entry type, defining an inner downturned end 32A and an outer slightly upturned end 32B. Rod 32 is welded at W to the underside of upper part 30A of connector 30.

Hence, when the connector lower portion 30B is engaged into channel 28 between sleeve 26 and main bracket plate 22, the hook 32 becomes frictionally releasably locked in place. Moreover, when an article is supported by this mounted display hook, the rod inner end 32A will abut against sleeve 26.

Rod 20,20C or rod 20,20D could be used on board 12, and rod 32 on board 10, while mounting bracket 18 could be fitted on board 12, and mounting bracket 18′ on board 10.

Bracket plate 22 provides a surface for affixing a label 34 to identify the articles suspended from the hook rod.

As shown in FIG. 6, adjacent bracket plates 22 can be in contact with adjacent fingers 24 inserted in a common bore 14, since fingers 24 are made of flat stock.

What I claim is:

1. A display hanger for a pegboard having a front and a rear face and provided with rows of bores, said hanger comprising a hook member and a mounting bracket for releasably connecting the hook member to the pegboard; said mounting bracket defining a main body provided at its top end with a pair of transverse anchoring fingers, said fingers being of arcuate-shape and adapted to engage a pair of horizontally-aligned pegboard bores and to rest against the pegboard rear face with the main body thereof flatly abutting against the pegboard front face; said hook member including: an elongated support rod member, having a horizontal top leg and a downturned leg projecting from the inner end portion of the top leg thereof, and a connector plate, having a horizontal top leg projecting from and anchored to the top face of said support rod member inner end portion and a downturned leg; further including a sleeve member mounted to the upper portion of said mounting bracket main body; said sleeve member defining a channel, said channel releasably frictionally engageable by said connector plate downturned leg; wherein upon hanging on said support rod member horizontal top leg a number of relatively heavy articles to be displayed, said hook member is prevented from downwardly collapsing under the load by the combined action of said rigid connector plate, the horizontal top leg of which is under tension by the weight of said hung articles, and of the resistance to flexion of said support rod member downturned leg which rests against said sleeve member; and wherein the support rod member is easily removable from said mounting bracket without having to remove said hung articles and with minimal vertical clearance.

2. A display hanger as in claim 1, wherein said support rod member makes with the plane of said mounting bracket main body an obtuse angle of about 115 degrees.

3. A display hanger as in claim 1, wherein said sleeve member is formed by a partially struckout portion of said mounting bracket main body integral with the latter at its two sides.

4. A display hanger as in claim 1, wherein said sleeve member is a rectangular extrusion made out from an upper section of said mounting bracket main body.

5. A display hanger as in claim 1, wherein each said arcuate finger is inversely C-shaped to form an anchor leg abutting against said pegboard rear face and at a position above the level of said connector plate; said anchor leg being wider than the remainder of said finger and abuttable against the pegboard rear face.

6. A display hanger as in claim 1, wherein said connector plate is made of a semiflexible metal leaf.

7. A display hanger as defined in claim 1, wherein said rigid connector plate horizontal top leg is of a wavy shape, to facilitate its anchoring to said inner end portion of said support rod member top leg by the method of spot-welding.

8. A display hanger as defined in claim 9, wherein said support rod member consists of a single rod forming a flattened loop, whose intermediate bent portion thereof is at the outer end of the support rod member horizontal leg, one end of said single rod abutting against the upper section of said sleeve member, the other end portion of said single rod forming said downturned rod member.

9. A display hanger as defined in claim 8, wherein said single rod other end portion defines a first downturned leg, approximately at right angle to said flattened loop portion, and a second leg projecting from the bottom end of the last=mentioned first leg and defining an axis approximately at right angle to both said flattened loop portion and the latter first leg, said first and second legs abutting against one side edge section and the bottom edge section of said sleeve member, respectively.

10. A display hanger as defined in claim 8, wherein said flattened loop intermediate bent portion is further slightly upwardly curved, to retain the hung article in place.

11. A display hanger as defined in claim 1, wherein said support rod member consists of a single rod forming a flattened loop whose intermediate bent portion is at the outer end of the support rod member horizontal leg, the two end portions of said single rod defining first and second downturned legs, each approximately at right angle to said flattened loop portion and abutting against one and the other side edge sections respectively of said sleeve member.

12. A display hanger as defined in claim 11, wherein said flattened loop intermediate bent portion is further slightly upwardly curved, to retain the hung article in place.

* * * * *